United States Patent [19]

Thornton et al.

[11] Patent Number: 4,722,163

[45] Date of Patent: Feb. 2, 1988

[54] VIBRATION-ISOLATING WALL TIE

[76] Inventors: Philip J. Thornton, 39 Thornley Street, Leichhardt, N.S.W., Australia, 2040; Carey Molloy, 8 Macauley Street, Bankstown, N.S.W., Australia, 2200

[21] Appl. No.: 948,302

[22] PCT Filed: Apr. 11, 1986

[86] PCT No.: PCT/AU86/00094

§ 371 Date: Nov. 18, 1986

§ 102(e) Date: Nov. 18, 1986

[87] PCT Pub. No.: WO86/06125

PCT Pub. Date: Oct. 23, 1986

[30] Foreign Application Priority Data

Apr. 12, 1985 [AU] Australia ..... PH0121

[51] Int. Cl.[4] ..... E04B 2/30; E04B 1/68

[52] U.S. Cl. ..... 52/713; 52/396; 52/403; 52/428; 52/562

[58] Field of Search ..... 52/713, 426, 428, 396, 52/394, 562, 403

[56] References Cited

U.S. PATENT DOCUMENTS

| | | | |
|---|---|---|---|
| 585,628 | 6/1897 | Meserve | 52/714 |
| 1,280,173 | 10/1918 | Cutler | 52/562 X |
| 3,438,211 | 4/1969 | Zywietz | 52/394 X |
| 3,964,226 | 6/1976 | Hala et al. | 52/562 |
| 4,110,948 | 9/1978 | Maier, Jr. | 52/403 X |

FOREIGN PATENT DOCUMENTS

| | | |
|---|---|---|
| 252523 | 6/1964 | Australia . |
| 1038261 | 6/1959 | Fed. Rep. of Germany . |
| 1502944 | 3/1978 | United Kingdom . |
| 2024889 | 1/1980 | United Kingdom . |

*Primary Examiner*—Alfred C. Perham

*Attorney, Agent, or Firm*—Beveridge, DeGrandi & Weilacher

[57] ABSTRACT

A vibration-isolating wall tie for use between the leaves of a cavity brick wall or between a load-bearing frame and a masonry veneer wall. The tie is formed in two parts (10, 11) engaging the respective walls, and these parts are joined by the engagement of a flange (13) on one part (10) with elastomeric material (15) in a U-shaped channel (14) in the other part (11). Apertures (18) are provided in each part to allow parallelogram distortion of the tie in response to loads parallel to the walls.

6 Claims, 4 Drawing Figures

VIBRATION-ISOLATING WALL TIE

FIELD OF THE INVENTION

This invention relates to vibration-isolating ties for use in the construction of masonry walls, such ties being employed, for example, in tying together the leaves of a cavity brick or block wall, or a masonry veneer wall and its load-bearing frame, while providing a degree of vibration isolation between the leaves or between the wall and frame.

SUMMARY OF THE INVENTION

The object of the invention is to provide a wall tie which will provide a useful degree of vibration isolation, while functioning satisfactorily to transfer lateral forces from one masonry leaf to the other or from a veneer leaf to the frame.

In accordance with the present invention a vibration isolating wall tie comprises first and second wall-engaging members each comprising a portion adapted for engagement with a wall and a portion extending therefrom to a free end, said first member having flange means at or adjacent its free end, said second member having resilient channel means at or adjacent its free end, said flange means being engaged within said channel means whereby said tie may transfer forces in a direction normal to the plane of said flange means.

Preferably, the first member comprises a substantially planar web portion with an upstanding transverse flange at the free end of said web, while the second member comprises a web portion with a lateral U portion at its free end, elastomeric material being provided within said U shaped portion to form a resilient channel tightly receiving said flange.

To facilitate an understanding of the present invention, reference will now be made to the accompanying drawings, where embodiments of the invention are illustrated by way of example only.

DESCRIPTION OF THE PREFERRED EMBODIMENT

Figure 1:
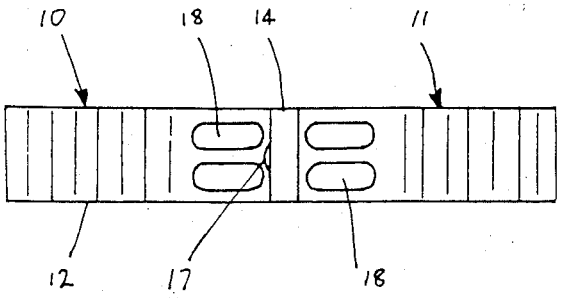
FIG. 1 is a plan view of a wall tie according to an embodiment of the invention.
Figure 2:
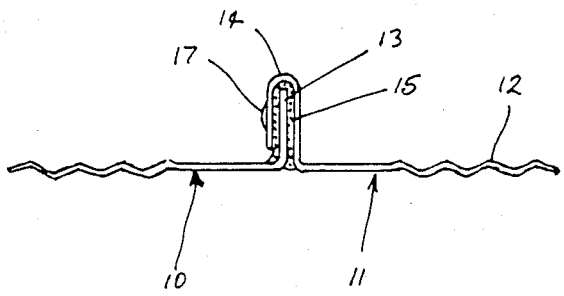
FIG. 2 is a side elevation of the tie of FIG. 1.
Figure 3:
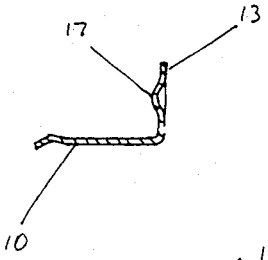
FIG. 3 is a fragmentary cross-sectional elevation of one of the members of the tie of FIG. 1.
Figure 4:
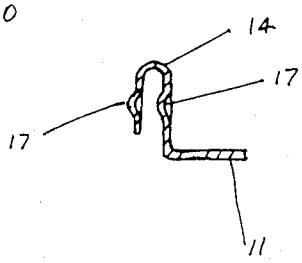
FIG. 4 is a fragmentary cross-sectional elevation of the other member of the tie of FIG. 1.

The illustrated wall tie is for use with cavity brick walls, and comprises a pair of members 10 and 11, each of which may be constructed from galvanised steel. Each member 10 and 11 comprises a portion 12 into which are pressed corrugations, these portions being designed to be laid between courses of masonry, and to extend into the wall cavity.

At the free end of the portion 10, there is provided an upstanding flange 13, disposed at right angles to the general plane of the member 10. The corresponding end of the member 11 is bent upwardly and folded downwardly to form a wide U shaped portion 14, the bight of the U being downwardly directed.

Substantially filling the interior of the U-shaped portion 14, is a strip 15 of elastomeric material such as open cell polyurethane, which has been bent over upon itself to form a U-shaped resilient member capable of firmly receiving and restraining the flange 13.

The flange 13 is provided with a centrally located dimple 16, and corresponding dimples 17 are provided in the legs of the portion 14, positioned to be aligned with the dimples 16 upon assembly of the tie. The distortion of the elastomeric material 15 by the co-operating dimples 16 and 17 provides a significant restraint against the relative lateral movement of the members 10 and 11.

Inwardly of the portion 14, in the assembled wall tie, the stiffness of the members 10 and 11 is reduced by a pair of apertures 18. While the shape and size of these apertures may be varied to modify the acoustic properties of the tie, the illustrated rectangular shape is preferred, as it allows parallelogram distortion of the tie in response to lateral relative wall movement, while providing appropriate structural stiffness of the tie.

It will be appreciated that many variations may be made in the design of wall ties embodying the principles outlined above. For example, the formations provided on the members 10 and 11 for engagement with their respective walls are capable of many variations to suit the particular application at hand, and the manner in which the apertures or other stiffness modifying formations are provided in the region of the interconnection of the two members, may also be varied.

We claim:

1. A vibration isolating wall tie comprising first and second wall-engaging members each having a portion adapted for engagement with a wall and a portion extending therefrom to a free end, said first member comprising a substantially planar web portion with an upstanding transverse flange at or adjacent its free end, said second member comprising a substantially planar web portion with a lateral U-shaped portion at its free end; and an elastomeric member positioned within said U-shaped portion of said second member so as to form a resilient channel within which the flange of said first member is tightly received whereby said tie may transfer forces in a direction normal to the plane of the flange of said first member, and the flange of said first member having formed on one side thereof a protruding formation so as to distort said elastomeric material.

2. A wall tie according to claim 1 wherein at least one of the legs of said U portion is provided with a protruding formation aligned with said formation of said flange means and protruding in the same direction thereas.

3. A wall tie according to claim 2 wherein each of the legs of said U portion is provided with such a formation.

4. A wall tie according to claim 3 wherein each said protruding means comprises a formation formed respectively in the flange and each leg.

5. A wall tie according to claim 1 wherein at least one aperture is provided in at least one of said members, said aperture forming a region of said member capable of parallelogram distortion in response to load applied to said tie within the plane of said members and parallel to said walls.

6. A wall tie according to claim 5 wherein each member is provided with a pair of substantially rectangular apertures disposed side-by-side across the width thereof.

* * * * *